US009151558B1

(12) United States Patent
Hirt et al.

(10) Patent No.: US 9,151,558 B1
(45) Date of Patent: Oct. 6, 2015

(54) SEAR TRIP BAR FOR A FIREARM

(71) Applicant: Sig Sauer, Inc., Newington, NH (US)

(72) Inventors: Robert Hirt, Exeter, NH (US); Christopher Sirois, Newfields, NH (US)

(73) Assignee: SIG SAUER, INC., Newington, NH (US)

( * ) Notice: Subject to any disclaimer, the term of this patent is extended or adjusted under 35 U.S.C. 154(b) by 0 days.

(21) Appl. No.: 14/518,620

(22) Filed: Oct. 20, 2014

Related U.S. Application Data

(63) Continuation-in-part of application No. 13/679,966, filed on Nov. 16, 2012, now abandoned.

(60) Provisional application No. 61/560,435, filed on Nov. 16, 2011, provisional application No. 61/893,563, filed on Oct. 21, 2013.

(51) Int. Cl.
*F41A 19/46* (2006.01)

(52) U.S. Cl.
CPC ..... *F41A 19/46* (2013.01)

(58) Field of Classification Search
CPC ..... F41A 19/46; F41A 19/45; F41A 19/33
USPC ..... 89/149, 140, 132, 128, 150
See application file for complete search history.

(56) References Cited

U.S. PATENT DOCUMENTS

| | | | |
|---|---|---|---|
| 2,482,758 | A | 9/1949 | Gaidos |
| 3,318,192 | A | 5/1967 | Miller et al. |
| 3,724,325 | A | 4/1973 | Silsby |
| 3,776,095 | A | 12/1973 | Atchisson |
| H0000926 | H | 6/1991 | Mahtook |
| 6,634,274 | B1 | 10/2003 | Herring |
| 8,667,882 | B1 | 3/2014 | Larson et al. |
| 2009/0031607 | A1 | 2/2009 | Robinson et al. |

FOREIGN PATENT DOCUMENTS

| | | |
|---|---|---|
| WO | 2013119291 | 8/2013 |

OTHER PUBLICATIONS

International Preliminary Report on Patentability for PCT Application No. PCT/US2012/065713, mailed May 20, 2014, 6 pages.

International Search Report and Written Opinion for PCT Application No. PCT/US2012/065713, mailed Jul. 22, 2013, 7 pages.

*Primary Examiner* — Reginald Tillman, Jr.

(74) *Attorney, Agent, or Firm* — Finch & Maloney PLLC

(57) ABSTRACT

A sear trip bar for use in an automatic firearm is disclosed. In accordance with some embodiments, the sear trip bar can be operatively interfaced with the bolt carrier and the automatic sear of the host firearm. The disclosed sear trip bar can be configured such that, upon sufficient displacement thereof (e.g., exhaustion of its stroke length) by the bolt carrier, the automatic sear may be caused to trip. Thus, the disclosed sear trip bar can be utilized, for example, to transfer the force of the moving bolt carrier during a given firing cycle to automatically trip the sear so as to initiate one or more subsequent firing cycles without having to release and again operate the trigger of the host firearm. The disclosed sear trip bar can be utilized, for example, in pistol-caliber and/or rifle-caliber automatic firearms.

20 Claims, 5 Drawing Sheets

Figure 3″

SEAR TRIP BAR FOR A FIREARM

CROSS-REFERENCE TO RELATED APPLICATIONS

This patent application is a Continuation-in-Part of U.S. patent application Ser. No. 13/679,966, titled "Firearm Actuation System," filed on Nov. 16, 2012, which claims the benefit of U.S. Provisional Patent Application No. 61/560,435, titled "Barrel Suppressor," filed on Nov. 16, 2011. This patent application also claims the benefit of U.S. Provisional Patent Application No. 61/893,563, titled "Sear Trip Bar for a Firearm," filed on Oct. 21, 2013. Each of these patent applications is herein incorporated by reference in its entirety.

FIELD OF THE DISCLOSURE

The present disclosure relates to firearms and more particularly to firearms configurable for automatic-fire capabilities.

BACKGROUND

Firearm design involves a number of non-trivial challenges, and compact firearms platforms have faced particular complications, such as those with respect to achieving automatic firing capabilities. Continued platform scaling will make these challenges even greater.

SUMMARY

One example embodiment provides a sear trip bar for a firearm, the sear trip bar including: an elongate body portion having a forward end and an opposing rearward end; a first hooked portion extending upwardly away from the forward end of the body portion and configured to be operatively interfaced with a bolt carrier of the firearm; and a second hooked portion extending laterally away from the rearward end of the body portion and configured to be operatively interfaced with an automatic sear of the firearm. In some cases, the body portion, the first hooked portion, and the second hooked portion are formed as a unitary component. In some cases, the first hooked portion and the second hooked portion are orthogonal to one another. In some instances, the first hooked portion extends upwardly away from the forward end of the body portion by a distance in the range of about 0.1-0.5 inches. In some instances, the second hooked portion extends laterally away from the rearward end of the body portion by a distance in the range of about 0.1-0.4 inches. In some cases, the body portion includes a first slot and a second slot formed therein, the first slot proximal to the forward end of the body portion, and the second slot proximal to the rearward end of the body portion, and the first and second slots are configured to provide the sear trip bar with a stroke length in the range of about 0.1-0.5 inches. In some cases, at least one of the first slot and the second slot has a length in the range of about 0.1-0.5 inches. In some instances, the first slot and the second slot are of different lengths. In some cases, at least a portion of the second hooked portion is offset in elevation with respect to the body portion by a distance in the range of about 0.01-0.1 inches.

Another example embodiment provides a firearm including: a lower receiver having an automatic sear disposed therein; and an upper receiver having a groove formed in an interior sidewall portion thereof, the upper receiver having disposed therein: a bolt carrier; and a sear trip bar including: a first portion configured to operatively interface with the bolt carrier; and a second portion configured to operatively interface with the automatic sear; wherein the sear trip bar resides, at least in part, within the groove of the upper receiver and is configured such that, upon sufficient forward displacement of the bolt carrier within the firearm, the sear trip bar trips the automatic sear to automatically initiate a firing cycle. In some cases, the sear trip bar further includes: a first slot defined therein proximal to the first portion; and a second slot defined therein proximal to the second portion. In some cases, the first slot and the second slot each have a rounded rectangular geometry and each have a length in the range of about 0.1-0.5 inches. In some instances, the sear trip bar further includes: a first retention pin disposed within the upper receiver and slidably inserted within the first slot of the sear trip bar; and a second retention pin disposed within the upper receiver and slidably inserted within the second slot of the sear trip bar. In some cases, the sear trip bar has a stroke length within the groove in the range of about 0.1-0.5 inches. In some instances, the sear trip bar resides, at least in part, adjacent to a hammer slot formed in the bolt carrier. In some cases, the firearm is chambered for pistol-caliber ammunition. In some other cases, the firearm is chambered for rifle-caliber ammunition.

Another example embodiment provides a firearm including: a bolt carrier having a notched portion formed in a bottom surface thereof, the notched portion adjacent to a hammer slot formed in the bolt carrier; an automatic sear having an actuating portion including a rear surface; and a sear trip bar including: an elongate body portion; a first hooked portion extending upwardly away from a forward end of the body portion, the first hooked portion configured to physically contact the notched portion of the bolt carrier; and a second hooked portion extending laterally away from a rearward end of the body portion, the second hooked portion orthogonal to the first hooked portion and configured to physically contact the rear surface of the actuating portion of the automatic sear; wherein the sear trip bar has a total length in the range of about 2-3 inches, and at least a portion of the sear trip bar has a thickness in the range of about 0.01-0.1 inches; wherein upon exhausting a stroke length of the sear trip bar, the automatic sear is tripped. In some cases, the stroke length is in the range of about 0.1-0.5 inches. In some instances, the firearm is a submachine gun.

The features and advantages described herein are not all-inclusive and, in particular, many additional features and advantages will be apparent to one of ordinary skill in the art in view of the drawings, specification, and claims. Moreover, it should be noted that the language used in the specification has been selected principally for readability and instructional purposes and not to limit the scope of the inventive subject matter.

BRIEF DESCRIPTION OF THE DRAWINGS

FIG. 3' is a partial magnified view of FIG. 3 showing operative interfacing between the sear trip bar and the bolt carrier.

FIG. 3" is a partial magnified view of FIG. 3 showing operative interfacing between the sear trip bar and the automatic sear.

Figure 1A:
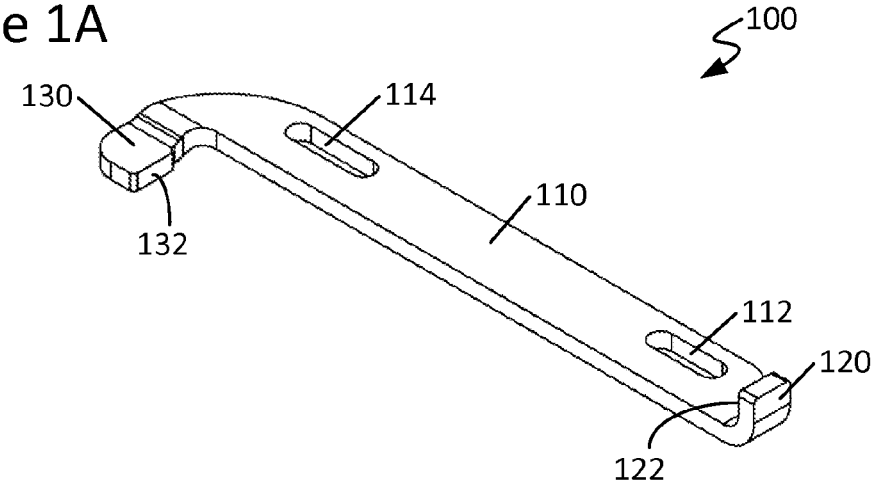
FIG. 1A is a perspective view of a sear trip bar configured in accordance with an embodiment of the present disclosure.
Figure 1B:
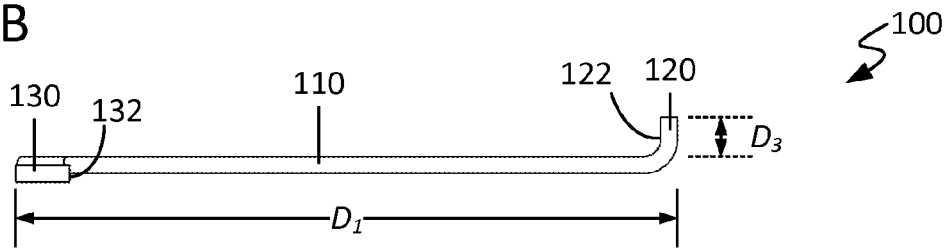
FIG. 1B is a side view of the sear trip bar of FIG. 1A.
Figure 1C:
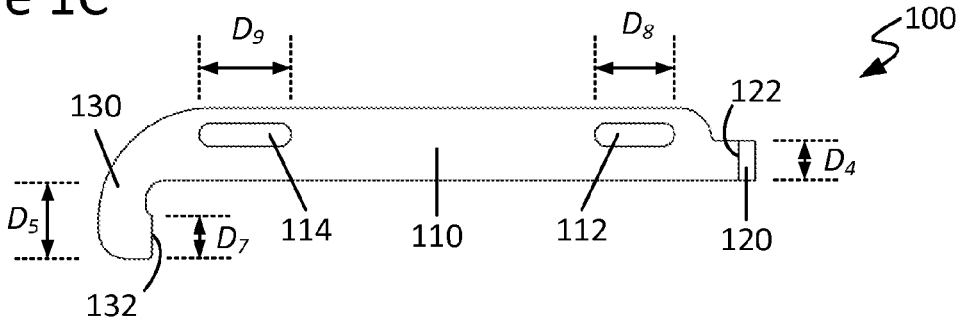
FIG. 1C is a top view of the sear trip bar of FIG. 1A.
Figure 1D:
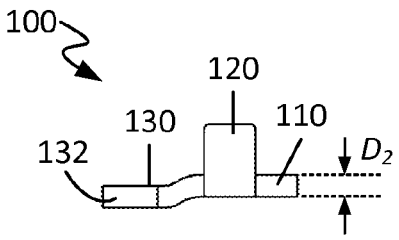
FIGS. 1D and 1E are forward and rearward end views, respectively, of the sear trip bar of FIG. 1A.
Figure 1E:
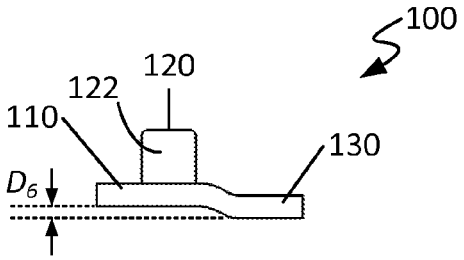

These and other features of the present embodiments will be understood better by reading the following detailed description, taken together with the figures herein described. In the drawings, each identical or nearly identical component that is illustrated in various figures may be represented by a like numeral. For purposes of clarity, not every component may be labeled in every drawing. Furthermore, as will be appreciated, the figures are not necessarily drawn to scale or intended to limit the present disclosure to the specific configurations shown. In short, the figures are provided merely to show example structures.

DETAILED DESCRIPTION

A sear trip bar for use in an automatic firearm is disclosed. In accordance with some embodiments, the disclosed sear trip bar can be operatively interfaced with the bolt carrier and the automatic sear of the host firearm. The disclosed sear trip bar can be configured such that, upon sufficient displacement thereof (e.g., exhaustion of its stroke length) by the bolt carrier, the automatic sear may be caused to trip, in accordance with some embodiments. Thus, the disclosed sear trip bar can be utilized, for example, to transfer the force of the moving bolt carrier during a given firing cycle to automatically trip the sear so as to initiate one or more subsequent firing cycles without having to release and again operate the trigger of the host firearm. The disclosed sear trip bar can be used, for example, in pistol-caliber and/or rifle-caliber automatic firearms. Numerous configurations and variations will be apparent in light of this disclosure.

General Overview

As previously indicated, there are a number of non-trivial issues that can complicate automatic firearms design. For example, as automatic firearms scale down in size, their internal componentry can require a similar reduction in size. For instance, as the bolt carrier of a given automatic firearm is reduced in length, the distance between the bolt carrier and the automatic sear of the firearm increases. Also, some existing approaches to tripping the automatic sear of an automatic firearm add mass to the moving bolt carrier and can render it prone to mechanical failure.

Thus, a sear trip bar for use in an automatic firearm is disclosed. In accordance with some embodiments, the disclosed sear trip bar can be operatively interfaced with the bolt carrier and the automatic sear of the host firearm. The disclosed sear trip bar can be configured such that, upon sufficient displacement thereof (e.g., exhaustion of its stroke length) by the bolt carrier, the automatic sear may be caused to trip, in accordance with some embodiments. Thus, the disclosed sear trip bar can be utilized, for example, to transfer the force of the moving bolt carrier during a given firing cycle to automatically trip the sear so as to initiate one or more subsequent firing cycles without having to release and again operate the trigger of the host firearm.

A sear trip bar configured as described herein can be utilized in any of a wide range of pistol-caliber and/or rifle-caliber automatic firearms, in accordance with some embodiments. For instance, some embodiments may be configured for use in a submachine gun or other pistol-caliber automatic firearm, such as the SIG MPX machine pistol produced by Sig Sauer, Inc. Some other embodiments may be configured for use in a rifle-caliber automatic firearm, such as the SIG MCX rifle produced by Sig Sauer, Inc. In some cases, a sear trip bar configured as described herein may be used, for example, in a firearm having a shortened bolt carrier. Other suitable host firearm platforms will be apparent in light of this disclosure.

In some embodiments, the disclosed sear trip bar may serve as a damper which can help to realize a reduction in bolt bounce exhibited by a host firearm, for example, during automatic firing thereof. In some embodiments, the disclosed sear trip bar may be a small form factor component constructed from materials that are lightweight, resilient, and/or inexpensive. In some such instances, minimal (or otherwise negligible) mass and/or bulk may be added to the host firearm, thereby helping to maintain a reliable, lightweight, compact automatic firearm. Also, in some instances, a reduction in cost (e.g., of production, repair, and/or replacement) may be realized.

By toggling the host firearm's safe/fire selector switch, the firearm's automatic sear can be rotated into and out of index with the firearm's hammer, and thus by virtue of how the sear trip bar and automatic sear are operatively interfaced, in accordance with some embodiments, the sear trip bar can be permitted and prevented, respectively, from operating to trip the automatic sear. That is, the disclosed sear trip bar can be configured, in some embodiments, such that it is allowed to move rearward and forward in a given firing cycle, but prevented from functioning to trip the automatic sear, for example, when the host firearm is put in a semi-automatic firing mode or safe mode. In turn, this can obviate the need to include additional componentry for purposes of preventing unwanted tripping of the automatic sear, which can help to reduce mechanical complexity and/or improve mechanical reliability of the host firearm, in some instances.

Structure

FIGS. 1A-1E illustrate several views of a sear trip bar 100 configured in accordance with an embodiment of the present disclosure. As described herein, sear trip bar 100 includes a body portion 110, a forward hooked portion 120, and a rearward hooked portion 130, and may have one or more slots 112, 114, etc., formed therein, in accordance with some embodiments. In some embodiments, sear trip bar 100 may be formed as a unitary component; that is, body portion 110, forward hooked portion 120, and rearward hooked portion 130 are formed from a single piece of material to provide a single, continuous element. In some other embodiments, however, sear trip bar 100 may be several separate elements that are operatively coupled with one another; that is, forward hooked portion 120 and/or rearward hooked portion 130 are attached to or otherwise assembled with body portion 110 (e.g., such as by welding, riveting, or other suitable technique for joining portions of sear trip bar 100).

The dimensions (e.g., length, width, thickness, etc.) of sear trip bar 100 can be customized for a given target application or end-use. For instance, in some embodiments, sear trip bar 100 may have a length $D_1$, for example, in the range of about 2.0-3.0 inches (e.g., about 2.0-2.25 inches, about 2.25-2.5 inches, about 2.5-2.75 inches, about 2.75-3.0 inches, or any other sub-range in the range of about 2.0-3.0 inches). It should be noted, however, that the present disclosure is not so limited, as sear trip bar 100 may be provided in longer or shorter lengths $D_1$, as desired.

Sear trip bar 100 can be constructed from any suitable material(s). For example, in some embodiments, sear trip bar 100 can be constructed from a stainless steel, such as AISI 1074 steel or AISI 1095 steel. As will be appreciated in light of this disclosure, it may be desirable in some instances to ensure that sear trip bar 100 is comprised of a material (or combination of materials), for example, which is corrosion-resistant, reliable over a wide temperature range (e.g., −50° F. to 170° F.), and/or resistant to deformation, fracture, and/or cyclic fatigue. In a more general sense, sear trip bar 100 can be constructed from any suitable material which is compliant, for example, with United States Defense Standard MIL-W-13855 (Weapons: Small Arms and Aircraft Armament Subsystems, General Specification For). Other suitable configurations, dimensions, and materials for sear trip bar 100 will depend on a given application and will be apparent in light of this disclosure.

In accordance with some embodiments, body portion 110 can be an elongate member having a substantially planar geometry. The dimensions (e.g., length, width, thickness, etc.) of body portion 110 can be customized for a given target application or end-use. In some embodiments, body portion 110 may have a thickness $D_2$, for example, in the range of about 0.01-0.1 inches (e.g., about 0.01-0.03 inches, about 0.03-0.06 inches, about 0.06-0.09 inches, or any other sub-range in the range of about 0.01-0.1 inches). In some cases, sear trip bar 100 may be substantially uniform in thickness along its length. In some other cases, however, a first portion of sear trip bar 100 may have a thickness within a first range, whereas a second portion thereof has a thickness within a second, different range.

Also, as can be seen from the figures, the forward end of body portion 110 includes hooked portion 120. In some cases, body portion 110 may transition to forward hooked portion 120, while in some other cases, forward hooked portion 120 may be attached to or otherwise assembled with body portion 110 at its forward end. In accordance with some embodiments, surface 122 of forward hooked portion 120 can be configured to operatively interface, for example, with a bolt carrier 200 (FIG. 2A), as discussed herein. That is, during a given firing cycle, surface 122 may come into physical contact with a notched portion 222 located on the underside of bolt carrier 200, in accordance with some embodiments.

The dimensions (e.g., length, width, height, curvature, etc.) of forward hooked portion 120 can be customized for a given target application or end-use. In some embodiments, forward hooked portion 120 may extend upwardly from body portion 110 by a distance $D_3$, for example, in the range of about 0.1-0.5 inches (e.g., about 0.1-0.2 inches, about 0.2-0.3 inches, about 0.3-0.4 inches, about 0.4-0.5 inches, or any other sub-range in the range of about 0.1-0.5 inches). In some embodiments, forward hooked portion 120 may have a width $D_4$, for example, in the range of about 0.1-0.4 inches (e.g., about 0.1-0.2 inches, about 0.2-0.3 inches, about 0.3-0.4 inches, or any other sub-range in the range of about 0.1-0.4 inches). In some embodiments, forward hooked portion 120 may have a thickness that is equal to the thickness $D_2$ of body portion 110. Other suitable configurations for the forward hooked portion 120 of sear trip bar 100 will depend on a given application and will be apparent in light of this disclosure.

Furthermore, as can be seen from the figures, the rearward end of body portion 110 includes hooked portion 130. In some cases, body portion 110 may transition to rearward hooked portion 130, while in some other cases, rearward hooked portion 130 may be attached to or otherwise assembled with body portion 110 at its rearward end. In accordance with some embodiments, surface 132 of rearward hooked portion 130 can be configured to operatively interface, for example, with an automatic sear 300 (discussed herein). That is, during a given firing cycle, surface 132 may come into physical contact with the rear surface 332 of the actuating portion 330 of automatic sear 300, in accordance with some embodiments.

The dimensions (e.g., length, width, height, curvature, etc.) of rearward hooked portion 130 can be customized for a given target application or end-use. In some embodiments, rearward hooked portion 130 may extend laterally from body portion 110 by a distance $D_5$, for example, in the range of about 0.1-0.4 inches (e.g., about 0.1-0.2 inches, about 0.2-0.3 inches, about 0.3-0.4 inches, or any other sub-range in the range of about 0.1-0.4 inches). In some embodiments, rearward hooked portion 130 also may be offset in elevation (e.g., downwardly offset) from body portion 110 by a distance $D_6$, for example, in the range of about 0.01-0.1 inches (e.g., about 0.1-0.3 inches, about 0.3-0.6 inches, about 0.6-0.9 inches, or any other sub-range in the range of about 0.01-0.1 inches). In some embodiments, surface 132 of rearward hooked portion 130 may have a width $D_7$, for example, in the range of about 0.1-0.4 inches (e.g., about 0.1-0.2 inches, about 0.2-0.3 inches, about 0.3-0.4 inches, or any other sub-range in the range of about 0.1-0.4 inches). In some embodiments, rearward hooked portion 130 may have a thickness that is equal to the thickness $D_2$ of body portion 110. Also, as can be seen from the figures, rearward hooked portion 130 may be substantially orthogonal to (e.g., at about 90° offset from) forward hooked portion 120, in accordance with some embodiments. Other suitable configurations for rearward hooked portion 130 of sear trip bar 100 will depend on a given application and will be apparent in light of this disclosure.

As previously noted, body portion 110 of sear trip bar 100 may have one or more slots formed therein. For instance, in some embodiments, body portion 110 of sear trip bar 100 may have a forward slot 112 and a rearward slot 114 formed therein. Each of forward slot 112 and rearward slot 114 may be formed in body portion 110 so as to traverse the full thickness $D_2$ of body portion 110 (i.e., pass completely through body portion 110 from one side thereof to the opposing side thereof), in accordance with some embodiments. Also, in accordance with some embodiments, forward slot 112 and rearward slot 114 may be substantially aligned (e.g., precisely or otherwise within an acceptable tolerance) with one another along the length of body portion 110, for example, so as not to inhibit the stroke length of sear trip bar 100, as discussed herein. Furthermore, in accordance with some embodiments, each of forward slot 112 and rearward slot 114 may be provided with a rounded rectangular geometry (e.g., a box-like shape having radiused or otherwise rounded ends). In some other embodiments, however, slots 112, 114, etc., may have a rectangular geometry (e.g., a box-like shape having right-angled or otherwise angled ends).

The dimensions (e.g., length and width) of a given slot 112, 114, etc., can be customized for a given target application or end-use. In some embodiments, forward slot 112 may have a length $D_8$, for example, in the range of about 0.1-0.5 inches (e.g., about 0.1-0.2 inches, about 0.2-0.3 inches, about 0.3-0.4 inches, about 0.4-0.5 inches, or any other sub-range in the range of about 0.1-0.5 inches). In some embodiments, rearward slot 114 may have a length $D_9$, for example, which is in the same example measurement range noted with respect to length $D_8$ of forward slot 112. In some cases, lengths $D_8$ and $D_9$ may be substantially equal, while in other cases, lengths $D_8$ and $D_9$ may be different from one another (e.g., the length $D_9$ of rearward slot 114 may be greater than the length $D_8$ of forward slot 112; the length $D_8$ of forward slot 112 may be greater than the length $D_9$ of rearward slot 114). Other suitable configurations for the one or more slots 112, 114, etc., will depend on a given application and will be apparent in light of this disclosure.

Figure 2A:
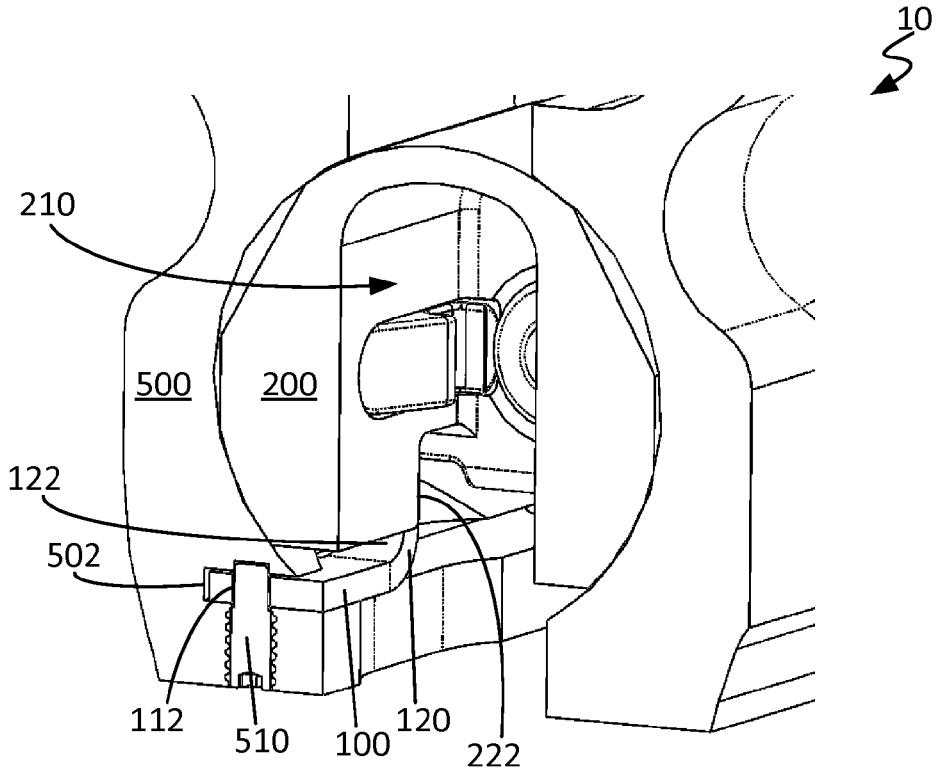
FIGS. 2A and 2B are partial cross-sectional views of an upper receiver of a firearm including a sear trip bar, in accordance with an embodiment of the present disclosure.
Figure 2B:
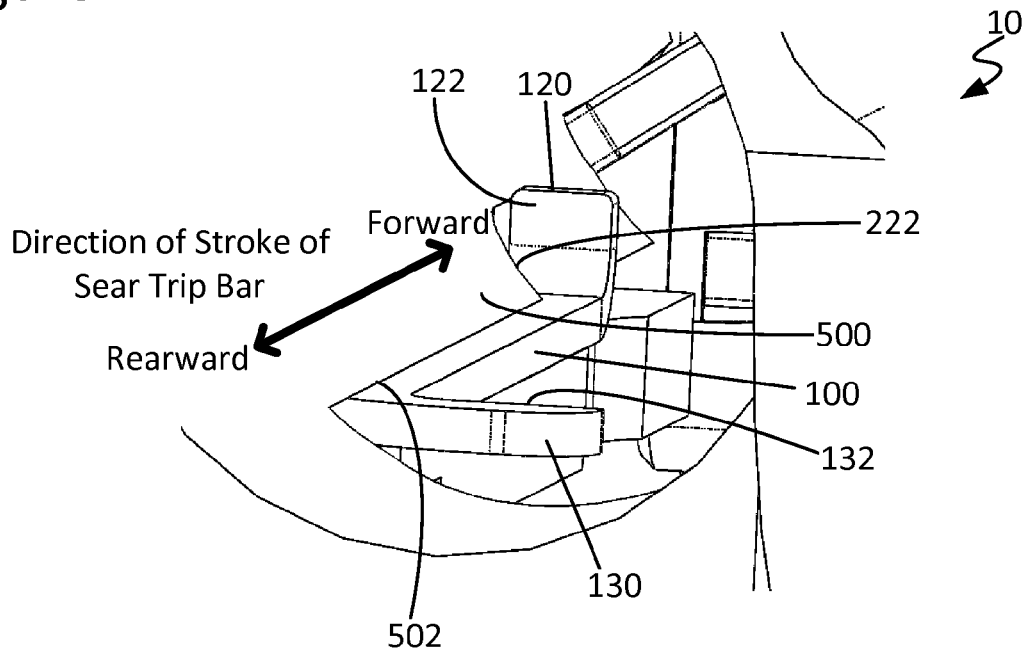

FIGS. 2A and 2B are partial cross-sectional views of an upper receiver 500 of a firearm 10 including a sear trip bar 100, in accordance with an embodiment of the present disclosure. As can be seen, each of the one or more slots 112, 114, etc., of sear trip bar 100 may be configured to receive therein a retention pin 510. The retention pin(s) 510 may be disposed, for example, within the upper receiver 500 of a host firearm 10 (e.g., such as is generally depicted in FIG. 2A). A given retention pin 510 may be configured to reside, in part, within a given slot 112, 114, etc., of sear trip bar 100. The dimensions (e.g., length, width/diameter, etc.) and geometry (e.g., rounded cross-section, angled cross-section, etc.) of a given retention pin 510 can be customized as desired for a given target application or end-use. In some embodiments, a given retention pin 510 may have a width/diameter which is less than the width/diameter of a corresponding slot 112, 114, etc.

As can be seen further, sear trip bar 100 may be configured to reside, at least in part, within a groove 502 formed in the upper receiver 500 of the host firearm 10. Groove 502 may be formed, for example, within an interior sidewall portion of upper receiver 500, in accordance with some embodiments. The dimensions (e.g., length, width, depth, etc.) of groove 502 can be customized for a given target application or end-use. As will be appreciated in light of this disclosure, it may be desirable to ensure that the dimensions of groove 502 are sufficient to accommodate sear trip bar 100. Other suitable arrangements for sear trip bar 100 within a given host firearm 10 will depend on a given application and will be apparent in light of this disclosure.

By virtue of how retention pins 510 are slidably inserted within the one or more slots 112, 114, etc., sear trip bar 100 may be permitted to slide in the forward and rearward directions, while being substantially prevented from moving from side to side (e.g., in the lateral directions), in accordance with some embodiments. Also, by virtue of how sear trip bar 100 is slidably inserted within groove 502, sear trip bar 100 may be permitted to slide in the forward and rearward directions, while being substantially prevented from moving upward and downward (e.g., in the vertical directions), in accordance with some embodiments. The range of forward and rearward motion (i.e., the stroke length) of sear trip bar 100 can be customized for a given target application or end-use. As will be appreciated in light of this disclosure, the stroke length of sear trip bar 100 may depend, at least in part, on the length $D_8$ of forward slot 112 and/or the length $D_9$ of rearward slot 114 (and/or the lengths of any other slots, if optionally provided). In some example cases, sear trip bar 100 may be configured to have a stroke length in the range of about 0.1-0.5 inches (e.g., about 0.1-0.2 inches, about 0.2-0.3 inches, about 0.3-0.4 inches, about 0.4-0.5 inches, or any other sub-range in the range of about 0.1-0.5 inches). As will be further appreciated, the stroke length of sear trip bar 100 may depend, at least in part, on the dimensions and/or geometry of retention pin(s) 510. For instance, if a given retention pin 510 is provided with a size that is similar to the size of a given slot 112, 114, etc., then the stroke length of sear trip bar 100 may be reduced as compared to a scenario in which the retention pin 510 is provided with a size which is dissimilar to the size of a given slot 112, 114, etc. If a given retention pin 510 is provided with a geometry that is not commensurate with the geometry of a given slot 112, 114, etc. (e.g., a square or angled retention pin 510 within a slot 112, 114, etc., having radiused ends), then the stroke length of sear trip bar 100 may be reduced as compared to a scenario in which the retention pin 510 is provided with a geometry which is commensurate with the geometry of a given slot 112, 114, etc. (e.g., a rounded or curved retention pin 510 within a slot 112, 114, etc., having radiused ends). Other suitable stroke lengths for sear trip bar 100 will depend on a given application and will be apparent in light of this disclosure.

As previously noted, sear trip bar 100 can be configured to operatively interface with the bolt carrier 200 of a host firearm 10, in accordance with some embodiments. In some cases, bolt carrier 200 can be a bolt carrier that is configured as traditionally done, as will be apparent in light of this disclosure. However, the present disclosure is not so limited, as in some other cases, bolt carrier 200 may be configured as a non-traditional and/or custom bolt carrier, as desired for a given target application or end-use.

In any such case, bolt carrier 200 may have a notched portion 222 formed on its underside, adjacent to its hammer slot 210. In accordance with some embodiments, forward hooked portion 120 of sear trip bar 100 may physically interface with notched portion 222 of bolt carrier 200. As discussed herein, physical interfacing of sear trip bar 100 with bolt carrier 200 can provide for transferring the force of the forward movement of bolt carrier 200 during a given firing cycle to automatic sear 300 (FIG. 3) for purposes of tripping the sear 300, in accordance with some embodiments. Also, the offset (e.g., laterally adjacent) location of notched portion 222 with respect to hammer slot 210 may help to ensure that sear trip bar 100 does not impede the operation of the hammer 410 and other firing mechanisms of the host firearm 10 while physically interfacing with notched portion 222. Other suitable configurations for bolt carrier 200 and its notched portion 222 will depend on a given application and will be apparent in light of this disclosure.

Also, as previously noted, sear trip bar 100 can be configured to operatively interface with the automatic sear 300 (FIG. 3) of a host firearm 10, in accordance with some embodiments. In some cases, automatic sear 300 can be an automatic sear assembly that is configured as traditionally done, as will be apparent in light of this disclosure. However, the present disclosure is not so limited, as in some other cases, automatic sear 300 may be configured as a non-traditional and/or custom automatic sear assembly, as desired for a given target application or end-use. In accordance with some embodiments, automatic sear 300 may be disposed, for example, in a lower receiver of host firearm 10.

In any such case, the automatic sear 300 may include an actuating portion 330 configured to sear with the hammer 410 of the host firearm 10. In accordance with some embodiments, rearward hooked portion 130 of sear trip bar 100 may physically interface with the rear surface 332 of actuating portion 330 of automatic sear 300. As discussed herein, physical interfacing of sear trip bar 100 with automatic sear 300 can provide for transferring the force of the forward movement of bolt carrier 200 during a given firing cycle to automatic sear 300 for purposes of tripping the sear 300.

Also, the arm portion 320 of automatic sear 300 and sear spring 340 may operate in conjunction with one another to operatively interface automatic sear 300 with a safe/fire selector switch 600 of the host firearm 10. As will be appreciated in light of this disclosure, toggling of that switch 600 (e.g., such as by rotation thereof) serves to change the angle of automatic sear 300 about its rotational axis, thus bringing actuating portion 330 into and out of index with hammer 410 of host firearm 10, consequently changing the firing mode thereof. Thus, in a sense, the operative interfacing between automatic sear 300 and safe/fire selector switch 600 contributes to enabling/disabling functional interaction between sear trip bar 100 and automatic sear 300, in accordance with some embodiments. Other suitable configurations for automatic sear 300 will depend on a given application and will be apparent in light of this disclosure.

Operation

Figure 3:
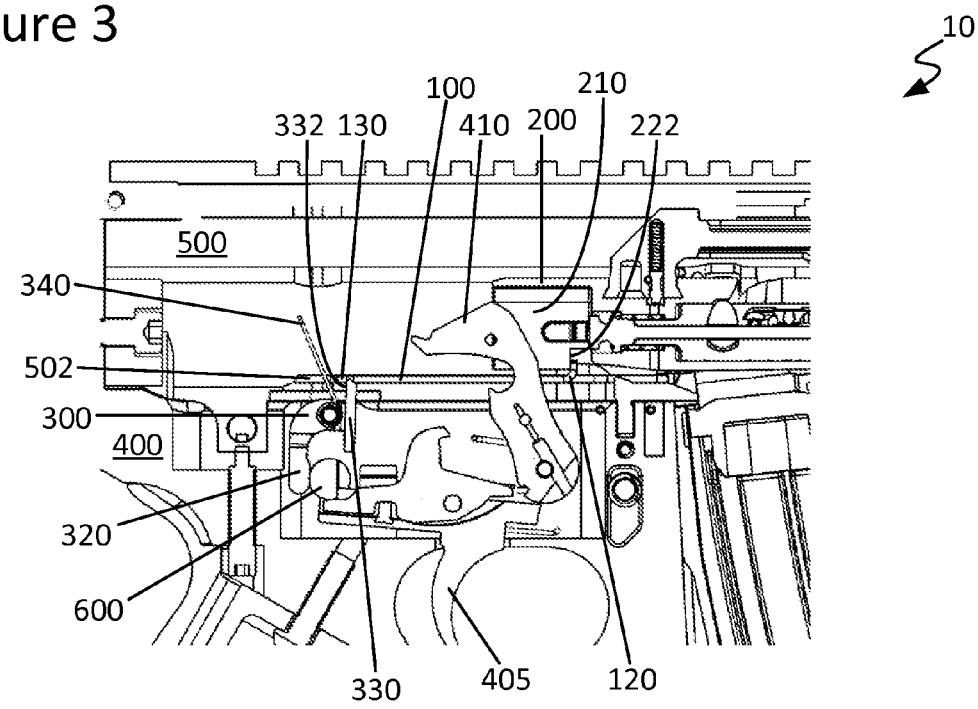
FIG. 3 is a cutaway side view of a firearm including a sear trip bar, in accordance with an embodiment of the present disclosure.
Figure 3:
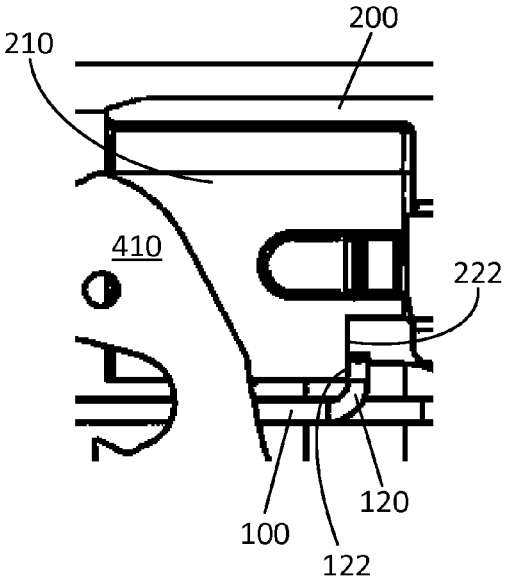
Figure 3:
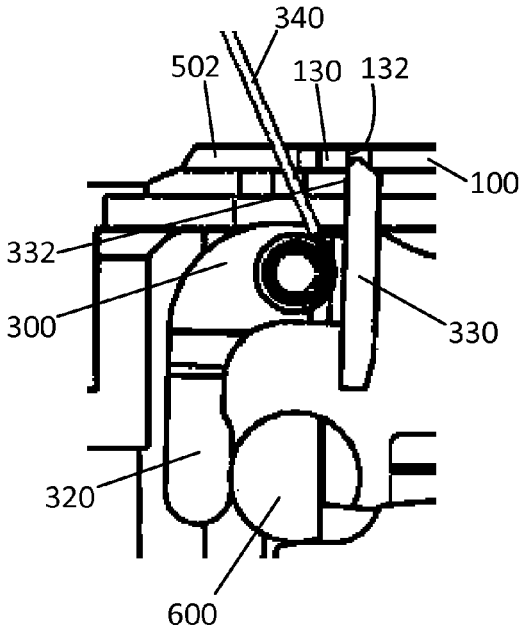

As described herein, and in accordance with some embodiments, sear trip bar 100 may be utilized to transfer the force of a moving bolt carrier 200 during a given firing cycle to initiate a subsequent firing cycle without need to release and once again operate the trigger 405 of the host firearm 10. To illustrate this, consider FIG. 3, which is a cutaway side view of a firearm 10 including a sear trip bar 100, in accordance with an embodiment of the present disclosure. At this depicted moment in the firing cycle, the hammer 410 of firearm 10 has been released and is traveling towards hammer slot 210 in bolt carrier 200. Also, as can be seen, sear trip bar 100 is simultaneously in physical contact with both of bolt carrier 200 and automatic sear 300 (i.e., there are two points of contact for sear trip bar 100). That is, as can be seen from FIG. 3', which is a partial magnified view of FIG. 3 showing operative interfacing between sear trip bar 100 and bolt carrier 200, surface 122 of forward hooked portion 120 and notched portion 222 are in physical contact with one another. Furthermore, as can be seen from FIG. 3", which is a partial magnified view of FIG. 3 showing operative interfacing between sear trip bar 100 and automatic sear 300, surface 132 of rearward hooked portion 130 and rear surface 332 of actuating portion 330 of sear 300 are in physical contact with one another.

Figure 4:
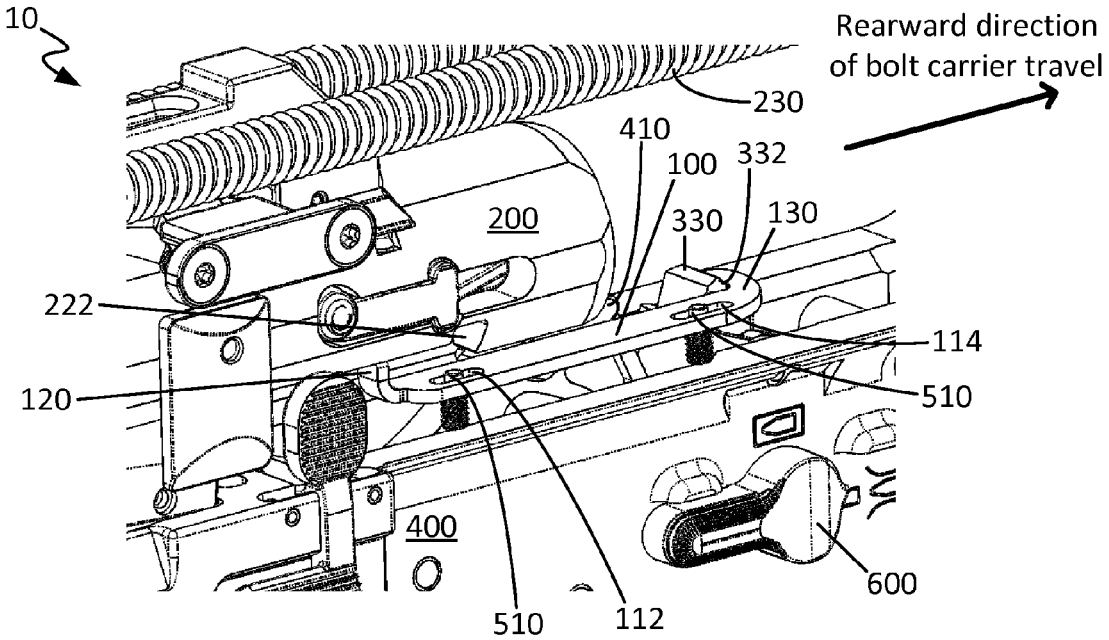
FIG. 4 is a cutaway perspective view of the firearm of FIG. 3 after discharge of a chambered round, in accordance with an embodiment of the present disclosure.

FIG. 4 is a cutaway perspective view of the firearm 10 of FIG. 3 after discharge of a chambered round, in accordance with an embodiment of the present disclosure. At this depicted moment in the firing cycle, bolt carrier 200 is moving rearward, taking notched portion 222 out of physical contact with forward hooked portion 120 of sear trip bar 100. As bolt carrier 200 moves away from forward hooked portion 120, the restoring force of sear spring 340 is momentarily unopposed by the restoring force of the recoil spring(s) 230 operatively coupled with bolt carrier 200. Thus, because rearward hooked portion 130 is still in physical contact with back surface 332 of actuating portion 330 of automatic sear 300, the restoring force of sear spring 340 causes automatic sear 300 to rotate rearward, forcing sear trip bar 100 rearward. Sear trip bar 100 continues to travel rearward until its rearward stroke length is exhausted (e.g., until it is arrested by retention pins 510 within slots 112, 114, etc.).

Figure 5:
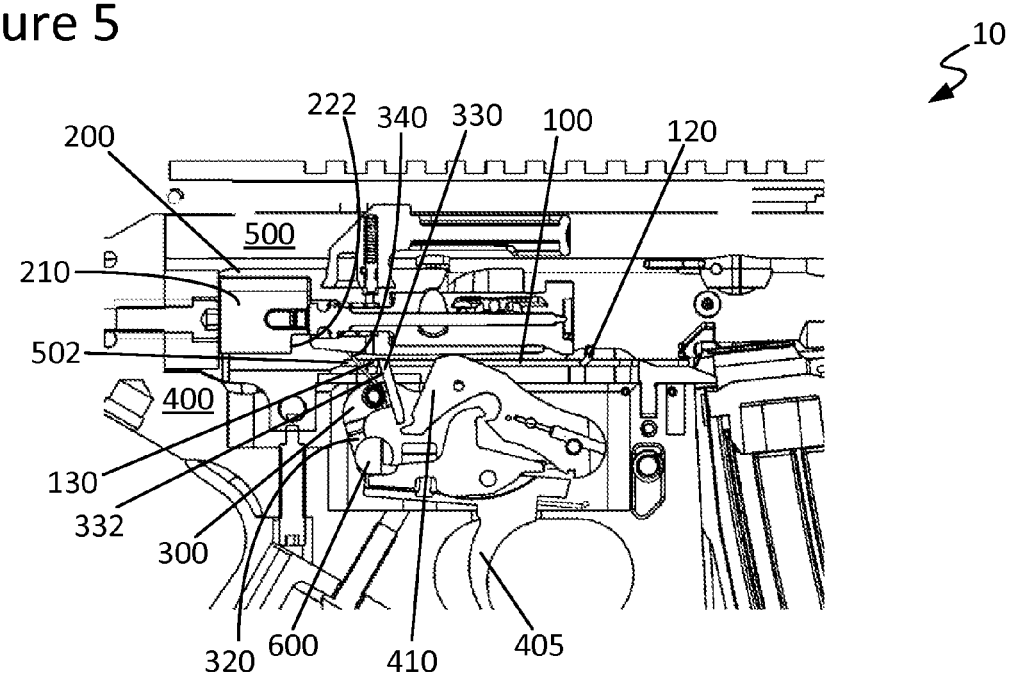
FIG. 5 is a side cutaway view of the firearm of FIG. 3 in the full recoil position, in accordance with an embodiment of the present disclosure.

FIG. 5 is a side cutaway view of the firearm 10 of FIG. 3 in the full recoil position, in accordance with an embodiment of the present disclosure. As bolt carrier 200 disengages sear trip bar 100 and moves rearward to the full recoil position, sear trip bar 100, automatic sear 300, and hammer 410 are allowed to reset for the next firing cycle. After reaching the full recoil position, the restoring force of the recoil spring(s) 230 moves bolt carrier 200 forward, toward the firing position. As bolt carrier 200 moves forward, physical contact between notched portion 222 of bolt carrier 200 and forward hooked portion 120 of sear trip bar 100 is reestablished. Thus, sear trip bar 100 is once again simultaneously in physical contact with both of bolt carrier 200 and automatic sear 300 (i.e., again, there are two points of contact for sear trip bar 100).

Figure 6A:
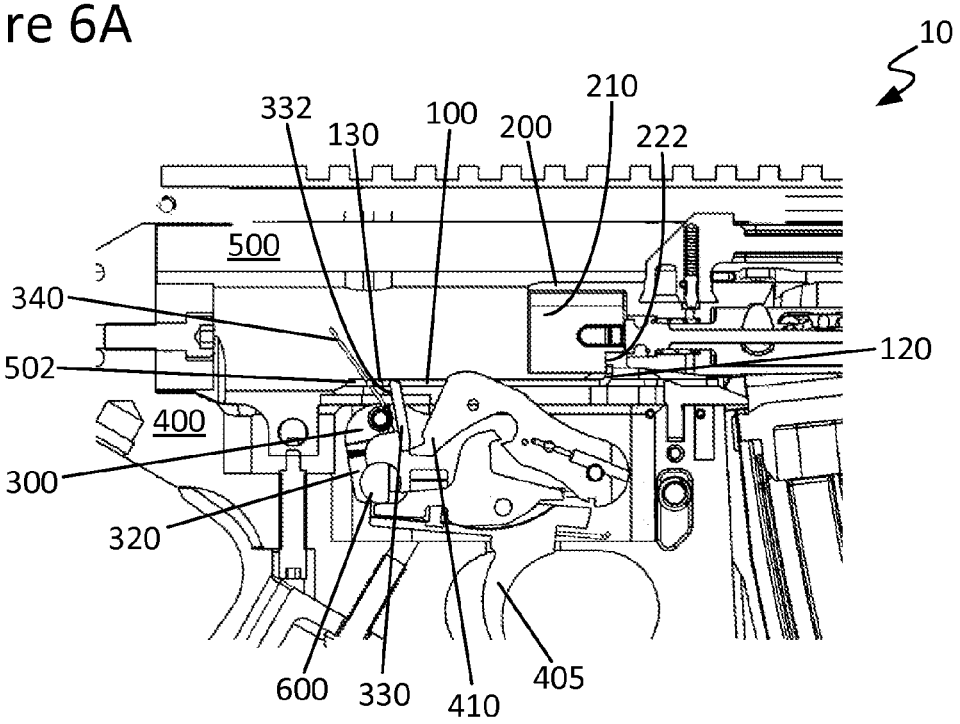
FIG. 6A is a side cutaway view of the firearm of FIG. 3 momentarily before tripping of the automatic sear by sear trip bar, in accordance with an embodiment of the present disclosure.
Figure 6B:
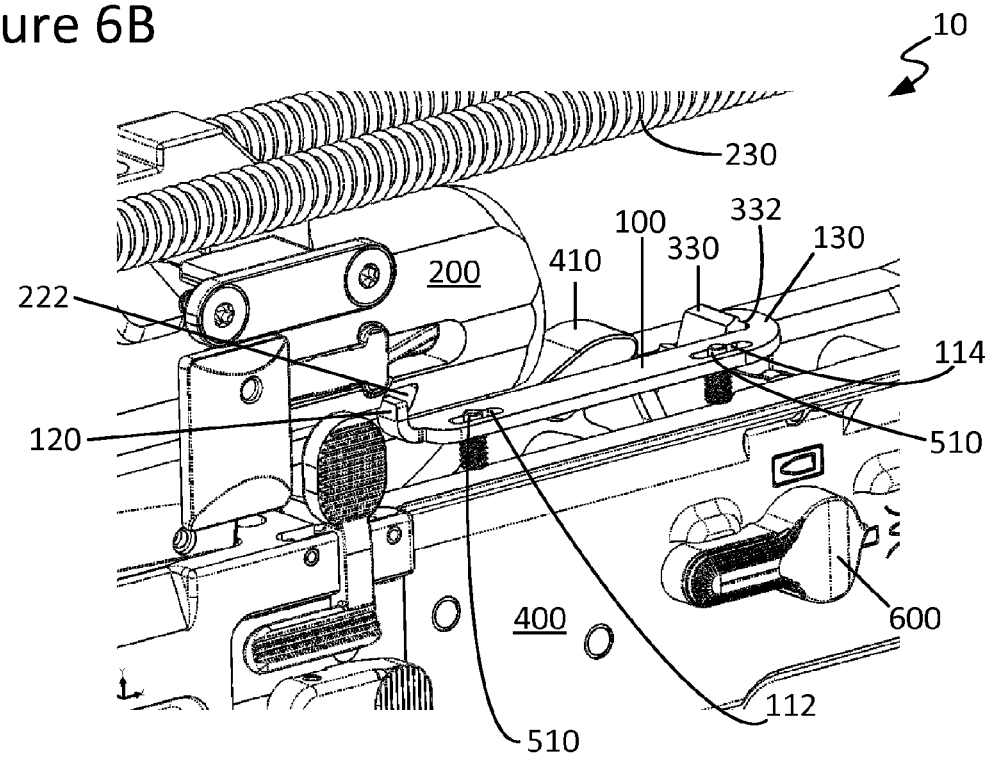
FIG. 6B is a cutaway perspective view of the firearm of FIG. 6A.

FIG. 6A is a side cutaway view of the firearm 10 of FIG. 3 momentarily before tripping of the automatic sear 300 by sear trip bar 100, in accordance with an embodiment of the present disclosure. At this depicted moment in the firing cycle, bolt carrier 200 is pulling sear trip bar 100 forward, which in turn causes rearward hooked portion 130 to pull on actuating portion 330 of automatic sear 300, rotating sear 300 forward about its axis of rotation. Also, as can be seen from FIG. 6B, which is a cutaway perspective view of the firearm 10 of FIG. 6A, sear trip bar 100 is in an intermediate position along its stroke length. That is, at this instant, sear trip bar 100 is neither fully forward, nor fully rearward. Thus, from a given intermediate position, sear trip bar 100 may have some amount of stroke length remaining before it is in its fully forward position (i.e., before its forward stroke length is exhausted). Therefore, if sear trip bar 100 were to be forced forward that remaining distance, thereby exhausting the stroke length of sear trip bar 100, automatic sear 300 would be caused to trip, as discussed herein. In some embodiments, sear trip bar 100 may have a remaining stroke length (e.g., from an intermediate position), for example, in the range of about 0.001-0.010 inches (e.g., about 0.001-0.003 inches, about 0.003-0.006 inches, about 0.006-0.009 inches, or any other sub-range in the range of about 0.001-0.010 inches). Other suitable remaining stroke lengths will depend on a given application and will be apparent in light of this disclosure.

If the operator has not released trigger 405, then as the bolt carrier 200 moves forward into the firing position, sear trip bar 100 travels forward in tandem with bolt carrier 200 until its stroke length is exhausted, causing automatic sear 300 to rotate and trip, releasing hammer 410 again and initiating the next firing cycle. If instead the operator has previously released trigger 405, then the current firing cycle will be completed, and the bolt carrier 200 will be returned to its firing position, thereby returning the firearm 10 to its ready-to-fire state.

The foregoing description of example embodiments has been presented for the purposes of illustration and description. It is not intended to be exhaustive or to limit the present disclosure to the precise forms disclosed. Many modifications and variations are possible in light of this disclosure. It is intended that the scope of the present disclosure be limited not by this detailed description, but rather by the claims appended hereto. Future-filed applications claiming priority to this application may claim the disclosed subject matter in a different manner and generally may include any set of one or more limitations as variously disclosed or otherwise demonstrated herein.

What is claimed is:

1. A sear trip bar for a firearm, the sear trip bar comprising:

an elongate body portion having a forward end and an opposing rearward end;

a first hooked portion extending upwardly away from the forward end of the body portion and configured to be operatively interfaced with a bolt carrier of the firearm; and a second hooked portion extending laterally away from the rearward end of the body portion and configured to be operatively interfaced with an automatic sear of the firearm.

2. The sear trip bar of claim 1, wherein the body portion, the first hooked portion, and the second hooked portion are formed as a unitary component.

3. The sear trip bar of claim 1, wherein the first hooked portion and the second hooked portion are orthogonal to one another.

4. The sear trip bar of claim 1, wherein the first hooked portion extends upwardly away from the forward end of the body portion by a distance in the range of about 0.1-0.5 inches.

5. The sear trip bar of claim 1, wherein the second hooked portion extends laterally away from the rearward end of the body portion by a distance in the range of about 0.1-0.4 inches.

6. The sear trip bar of claim 1, wherein the body portion includes a first slot and a second slot formed therein, the first slot proximal to the forward end of the body portion, and the second slot proximal to the rearward end of the body portion, and wherein the first and second slots are configured to provide the sear trip bar with a stroke length in the range of about 0.1-0.5 inches.

7. The sear trip bar of claim 6, wherein at least one of the first slot and the second slot has a length in the range of about 0.1-0.5 inches.

8. The sear trip bar of claim 6, wherein the first slot and the second slot are of different lengths.

9. The sear trip bar of claim 1, wherein at least a portion of the second hooked portion is offset in elevation with respect to the body portion by a distance in the range of about 0.01-0.1 inches.

10. A firearm comprising:

a lower receiver having an automatic sear disposed therein; and an upper receiver having a groove formed in an interior sidewall portion thereof, the upper receiver having disposed therein:

a bolt carrier; and a sear trip bar comprising:

a first hooked portion configured to operatively interface with the bolt carrier; and a second hooked portion configured to operatively interface with the automatic sear;

wherein the sear trip bar resides, at least in part, within the groove of the upper receiver and is configured such that, upon sufficient forward displacement of the bolt carrier within the firearm, the sear trip bar trips the automatic sear to automatically initiate a firing cycle.

11. The firearm of claim 10, wherein the sear trip bar further comprises:

a first slot defined therein proximal to the first hooked portion; and a second slot defined therein proximal to the second hooked portion.

12. The firearm of claim 11, wherein the first slot and the second slot each have a rounded rectangular geometry and each have a length in the range of about 0.1-0.5 inches.

13. The firearm of claim 11 further comprising:

a first retention pin disposed within the upper receiver and slidably inserted within the first slot of the sear trip bar; and a second retention pin disposed within the upper receiver and slidably inserted within the second slot of the sear trip bar.

14. The firearm of claim 10, wherein the sear trip bar has a stroke length within the groove in the range of about 0.1-0.5 inches.

15. The firearm of claim 10, wherein the sear trip bar resides, at least in part, adjacent to a hammer slot formed in the bolt carrier.

16. The firearm of claim 10, wherein the firearm is chambered for pistol-caliber ammunition.

17. The firearm of claim 10, wherein the firearm is chambered for rifle-caliber ammunition.

18. A firearm comprising:

a bolt carrier having a notched portion formed in a bottom surface thereof, the notched portion adjacent to a hammer slot formed in the bolt carrier;

an automatic sear having an actuating portion including a rear surface; and a sear trip bar comprising:

an elongate body portion having a forward end and an opposing rearward end;

a first hooked portion extending upwardly away from the forward end of the elongate body portion, the first hooked portion configured to physically contact the notched portion of the bolt carrier; and a second hooked portion extending laterally away from the rearward end of the elongate body portion, the second hooked portion orthogonal to the first hooked portion and configured to physically contact the rear surface of the actuating portion of the automatic sear;

wherein the sear trip bar has a total length in the range of about 2-3 inches, and at least a portion of the sear trip bar has a thickness in the range of about 0.01-0.1 inches;

wherein upon exhausting a stroke length of the sear trip bar, the automatic sear is tripped.

19. The firearm of claim 18, wherein the stroke length is in the range of about 0.1-0.5 inches.

20. The firearm of claim 18, wherein the firearm comprises a submachine gun.

* * * * *